US008347980B2

(12) United States Patent
Wagner et al.

(10) Patent No.: US 8,347,980 B2
(45) Date of Patent: Jan. 8, 2013

(54) HYDRAULIC AGGREGATE FOR HYDRAULIC POWER WRENCHES

(75) Inventors: Paul-Heinz Wagner, Much-Birrenbachshöhe (DE); Bernd Thelen, Much (DE); Ulf Sittig, Nümbrecht (DE); Günter Andres, Much (DE)

(73) Assignee: Wagner Vermögensverwaltungs-GmbH & Co. KG, Much (DE)

( * ) Notice: Subject to any disclaimer, the term of this patent is extended or adjusted under 35 U.S.C. 154(b) by 489 days.

(21) Appl. No.: 12/525,444

(22) PCT Filed: Jan. 25, 2008

(86) PCT No.: PCT/EP2008/050877

§ 371 (c)(1),
(2), (4) Date: Mar. 12, 2010

(87) PCT Pub. No.: WO2008/092808

PCT Pub. Date: Aug. 7, 2008

(65) Prior Publication Data

US 2010/0170689 A1 Jul. 8, 2010

(30) Foreign Application Priority Data

Feb. 2, 2007 (DE) ..... 20 2007 001 537 U

(51) Int. Cl.
*B25B 23/145* (2006.01)

(52) U.S. Cl. ..... 173/177; 173/4; 173/11; 173/218

(58) Field of Classification Search ..... 173/177, 173/4, 11, 218; 417/46; 60/421
See application file for complete search history.

(56) References Cited

U.S. PATENT DOCUMENTS

| | | | | | |
|---|---|---|---|---|---|
| 3,907,043 | A * | 9/1975 | Appleman | 173/218 |
| 3,930,776 | A * | 1/1976 | Keller | 173/218 |
| 4,300,641 | A * | 11/1981 | Kinkel | 173/177 |
| 4,864,903 | A * | 9/1989 | Bickford et al. | 81/467 |
| 5,186,262 | A * | 2/1993 | Thompson | 173/182 |
| 5,782,158 | A * | 7/1998 | Rothering | 91/38 |
| 6,966,240 | B2 * | 11/2005 | Kipfelsberger | 81/57.44 |
| 2005/0210872 | A1 | 9/2005 | Wagner | |
| 2008/0302097 | A1 | 12/2008 | Andres et al. | |
| 2009/0000397 | A1 | 1/2009 | Wagner et al. | |

FOREIGN PATENT DOCUMENTS

| | | |
|---|---|---|
| DE | 1292004 | 4/1969 |
| DE | 4111196 | 10/1992 |
| DE | 102004058338 | 6/2006 |
| JP | 01-22167 | 9/1990 |
| JP | 03-264271 | 11/1991 |

OTHER PUBLICATIONS

International Search Report for corresponding application No. PCT/EP2008/050877 completed May 23, 2008.
Japanese Office Action for corresponding Japanese Patent Application No. 2009-547647 dated Sep. 4, 2012.

* cited by examiner

*Primary Examiner* — Brian D Nash
(74) *Attorney, Agent, or Firm* — Renner, Otto, Boisselle & Sklar, LLP

(57) ABSTRACT

A hydraulic aggregate comprises a container, a reservoir for hydraulic oil, and a pump driven by a motor arranged in the reservoir. The motor is a pneumatic motor. An electric control unit for controlling a main valve is mounted on the container. The main valve causes a reversal of the stroke direction of the hydraulic connections. The division into pneumatics and low power electronics leads to an explosion-proof embodiment of low weight and little technical complexity.

5 Claims, 2 Drawing Sheets

HYDRAULIC AGGREGATE FOR HYDRAULIC POWER WRENCHES

The invention relates to a hydraulic aggregate for feeding oil to a hydraulic power wrench, said aggregate comprising an oil reservoir provided with a motor arranged therein as a submerged motor, a pump driven by said motor, and a control unit for controlling a reversal of the stroke direction of the power wrench in dependence on the pressure at the outlet of the hydraulic aggregate.

BACKGROUND

A hydraulic aggregate of the above type is described in WO 2006/103199 A1 (Wagner). This hydraulic aggregate comprises a reservoir provided with a submerged motor submerged into the oil contained in the reservoir. The submerged motor has no casing so that the oil is able to reach all functional components of the motor and will also fill out the gap between stator and rotor. The motor is arranged to drive a multi-piston pump comprising distributed individual pumps. The individual pumps are cyclically actuated by an eccentric which is mounted on the motor shaft. A pump of this type has a star-shaped configuration, and, within the cylindrical reservoir, the pump is arranged in a cross-sectional plane. The hydraulic aggregate is provided with a motor control unit arranged on the housing of the reservoir and accommodated within a separate device housing.

Customary hydraulic aggregates for power wrenches are used in an environment where no specific risk of explosions prevails. This allows for the use of an electric motor for driving the multi-piston pump. For hydraulic aggregates which have to be run in an environment with explosion hazard, this known hydraulic aggregate with its uncased motor will not be suited. The electric motor may happen to inflame the oil contained within the reservoir. Providing an explosion-proof encapsulation would require a considerable increase in volume and weight.

SUMMARY OF THE INVENTION

The invention provides a hydraulic aggregate for a hydraulic power wrench, said aggregate being optimized with regard to the operating modes.

More particularly, a hydraulic aggregate for feeding oil to a hydraulic power wrench, comprises a reservoir containing oil and provided with a motor arranged therein as a submerged motor, a pump driven by the motor, and a control unit for controlling a reversal of the stroke direction of the power wrench in dependence on the pressure at the outlet of the hydraulic aggregate, The motor is a pneumatic motor and the control unit is designed as an electronic control unit. The pneumatic motor is energized by an external source of pressurized air. In a pneumatic motor, in contrast to an electric motor, no flow of electric currents will occur, thus precluding the possibility of sparks caused by slip rings and the like, or of wires becoming overheated due to current flow. The pneumatic motor is operated with pressurized air so that no additional inflammable substances will be introduced into the reservoir. The control unit belonging to the hydraulic aggregate is operated electrically. Preferably, the control unit is accommodated in an explosion-proof device housing of its own. Under the concept of the invention, a bipartition is provided: The motor, as a consumer operated with high current intensities, is replaced by a pneumatic motor which is free of electric currents, whereas the control unit or "intelligence", which is provided by microelectronics, will remain of the electric type. This split solution leads to a relatively inexpensive and light-weighted hydraulic aggregate which can be easily carried to the respective site of operation of the power wrenches. A pneumatic solution for the control unit, by contrast, would suffer from the disadvantages of a large weight and of a massive susceptibility to failure when exposed to the rough environment at construction sites. The invention makes it possible to reach a high switching accuracy at relatively low expenditure. Since the control unit is of the electronic type, it is rendered possible to realize functions such as, for instance, automatic end-position control, rotational moment/rotational angle screwing method, and documentation of screwing parameters, as is described in DE 102 22 159 and 10 2004 017979.

The hydraulic motor submerged into the hydraulic oil is effective to cool the hydraulic oil by pressure release of the pressurized air leaving the motor. Further, the hydraulic oil will keep the pneumatic motor from freezing. Thus, a thermally advantageous interaction exists between the pneumatic motor and the hydraulic pump circuit.

According to a preferred embodiment of the invention, the control unit is connected, via an electric line, to an electrically controlled drive valve provided to control the supply of pressurized air to a main valve effecting the reversal of the stroke direction of the piston of the power wrench. The drive valve will cause a power increase of the low-power signals of the electronic control unit. In the main valve were controlled electrically, this would lead to a high consumption of electric current already by the main valve alone, with the consequent need of further protective measures against explosions.

A preferred embodiment of the invention provides that the control unit includes an accumulator for electric current supply of the electronic control unit. Thus, the hydraulic aggregate is independent from the mains supply. The accumulator is able to deliver a lower operative voltage of 12 or 24 Volts, which is sufficient for the operation of the control unit. By the provision of the accumulator, the mobility of the hydraulic aggregate is improved. The hydraulic aggregate merely requires a pressurized-air connection. The pressurized air can be obtained from a remote pressurized-air source and be supplied via a flexible tube. A return flow is not required in the pressurized-air system. Of particular advantage is the combination of the accumulator/current supply with an electrically controlled pneumatic drive valve. Thereby, the demand posed on the accumulator does not exceed the supply of relatively low consumption currents. The pneumatic pressure system has a relatively low pressure in the order of magnitude of 10 bar, while the hydraulic system of a power wrench is operative with a pressure in the range of several 100 bars.

The hydraulic aggregate of the invention is suited for use in environments with explosion hazard, e.g. for oil or gas pipelines as well as in the chemical industry or in mining. The electric part is provided in an explosion-proof design in accordance with Atex regulations. This involves a corresponding encapsulation of the housings and the conduit feedthrough passages.

An embodiment of the invention will be explained in greater detail hereunder with reference to the drawings.

DETAILED DESCRIPTION

Figure 1:
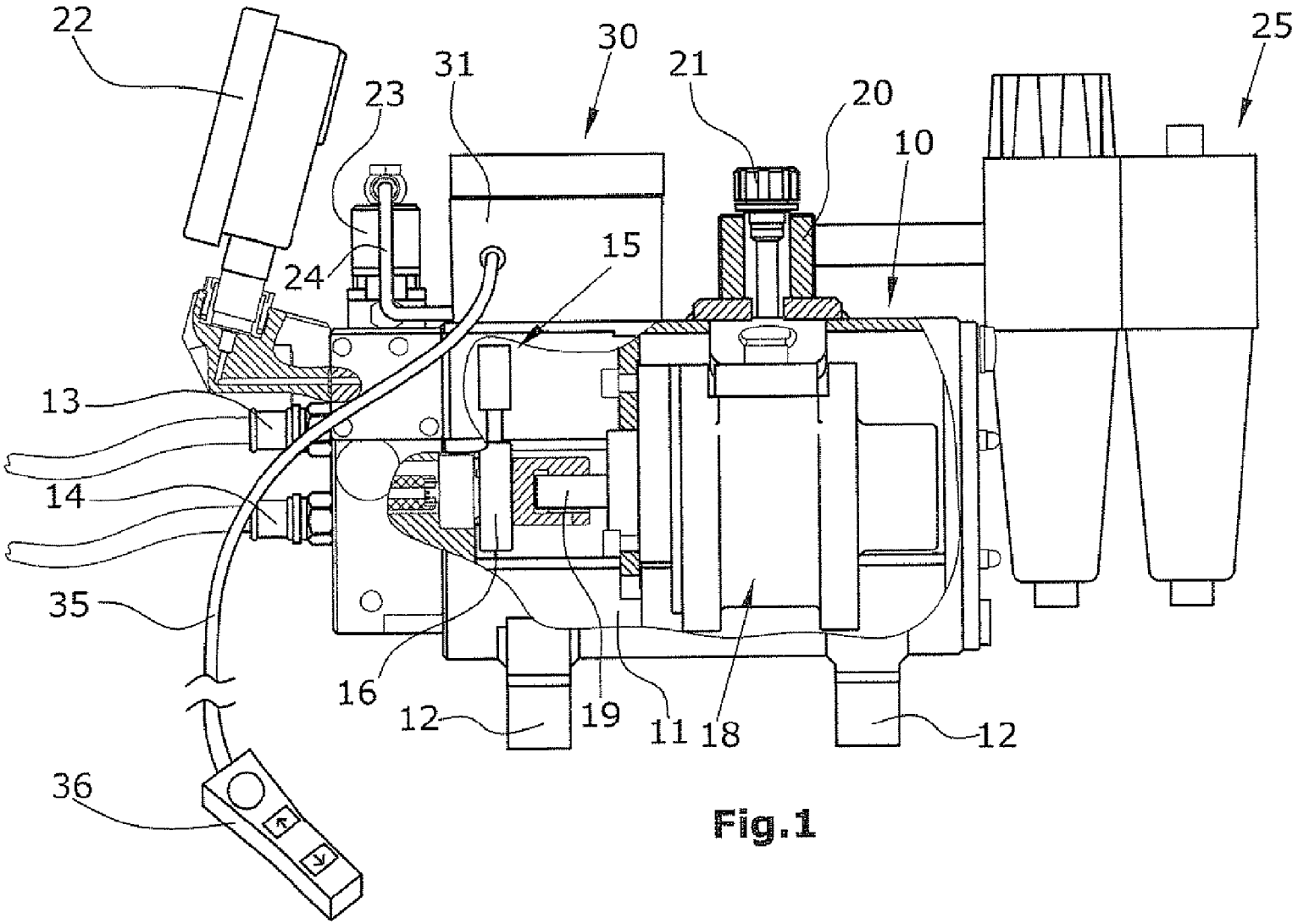
FIG. 1 is a partially sectional lateral view of the hydraulic aggregate.

The hydraulic aggregate comprises a substantially cylindrical container 10 enclosing the reservoir 11 for the hydraulic medium. Container 10 is provided with support feet 12 for placement of the container on the ground. The support feet 12 extend from the peripheral wall of the container.

Arranged on the front end of the container are hydraulic connectors 13 and 14 for connection of tubes (not shown) leading to a hydraulic power wrench. One tube connector 13 is the pressure connector and the other tube connector 14 is the return-flow connector. The hydraulic pressure that the hydraulic aggregate is capable to supply is in the range of several 100 bars.

Internally of container 10, a multi-piston pump 15 is arranged which is designed in the same manner as described in WO 2006/103199 A1. The individual pump segments, arranged in a star-shaped configuration around a shaft, will be cyclically driven by an eccentric 16 mounted to said shaft, so that the pump segments will successively suck in hydraulic oil and discharge it under high pressure. Said multi-piston pump 15 is driven by a motor 18 arranged within reservoir 11. Motor 18 is a pneumatic motor with oil-tight casing. Motor 18 is operative to drive a shaft 19 arranged to drive said eccentric 16. Further, motor 18 is connected via a tube conduit to a source of pressurized air.

Container 10 is provided with an oil filler connector 20 adapted to be closed by a screw-on lid 21.

On the front side of container 10, a manometer 22 is provided for indication of the pressure in the hydraulic line. Also the pneumatically actuated hydraulic main valve 23 for control of the reversal of the flow direction of the power wrench is fastened to container 10. Main valve 23 is pneumatically actuated by drive valve 26. The pressurized-air line, which is connected to a source (not shown) of pressurized-air, is provided to energize the drive valve 26 and the pneumatic motor 18. From drive valve 26, a pneumatic control line is led to main valve 23.

Fastened to the rear end wall of container 10 is a conditioning unit 25 belonging to the pneumatics, which includes filters, water separators, lubricators and pressure reducers and will deliver the pressurized air to the main valve 23 and the pneumatics motor.

To the top side of container 10, there is attached the electronic control unit 30 which is accommodated in a housing 31 with explosion-proof encapsulation. The control unit comprises the required hardware and software. It is connected to various sensors, among them particularly the pressure sensors for measurement of the pressure in the hydraulic line. On the basis of the level of this pressure, it is possible to determine the load acting on the power wrench. The power wrench comprises a piston driven for reciprocating movement. When this piston reaches an end position within the hydraulic cylinder, the pressure will undergo a steep increase. This steep temporal pressure increase is detected by the control unit and is utilized for reversal of direction. This reversal of directions is effected by the main valve 23 alternately switching the hydraulic connectors 13,14 between pressure and return flow. Control of main valve 23 is performed by drive valve 26 as controlled by control unit 30. No electrically operable valve is included in the oil supply system for the power wrench.

Control unit 30 is further connected, via a cable 35, to remote control unit 36. The remote control unit, being of the hand-held type, comprises manually operable keys for selection between advance stroke and return stroke. Further, the remote control unit can be operated for switching to automatic reversal of stroke direction. Remote control unit 36 is connected to the electric control unit which in turn will correspondingly actuate the main valve 23.

For energy supply to the control system, control unit 30 includes an accumulator, i.e. a rechargeable battery. Said battery serves for maintaining the function of data processing and control and also for driving the main valve 23.

Figure 2:
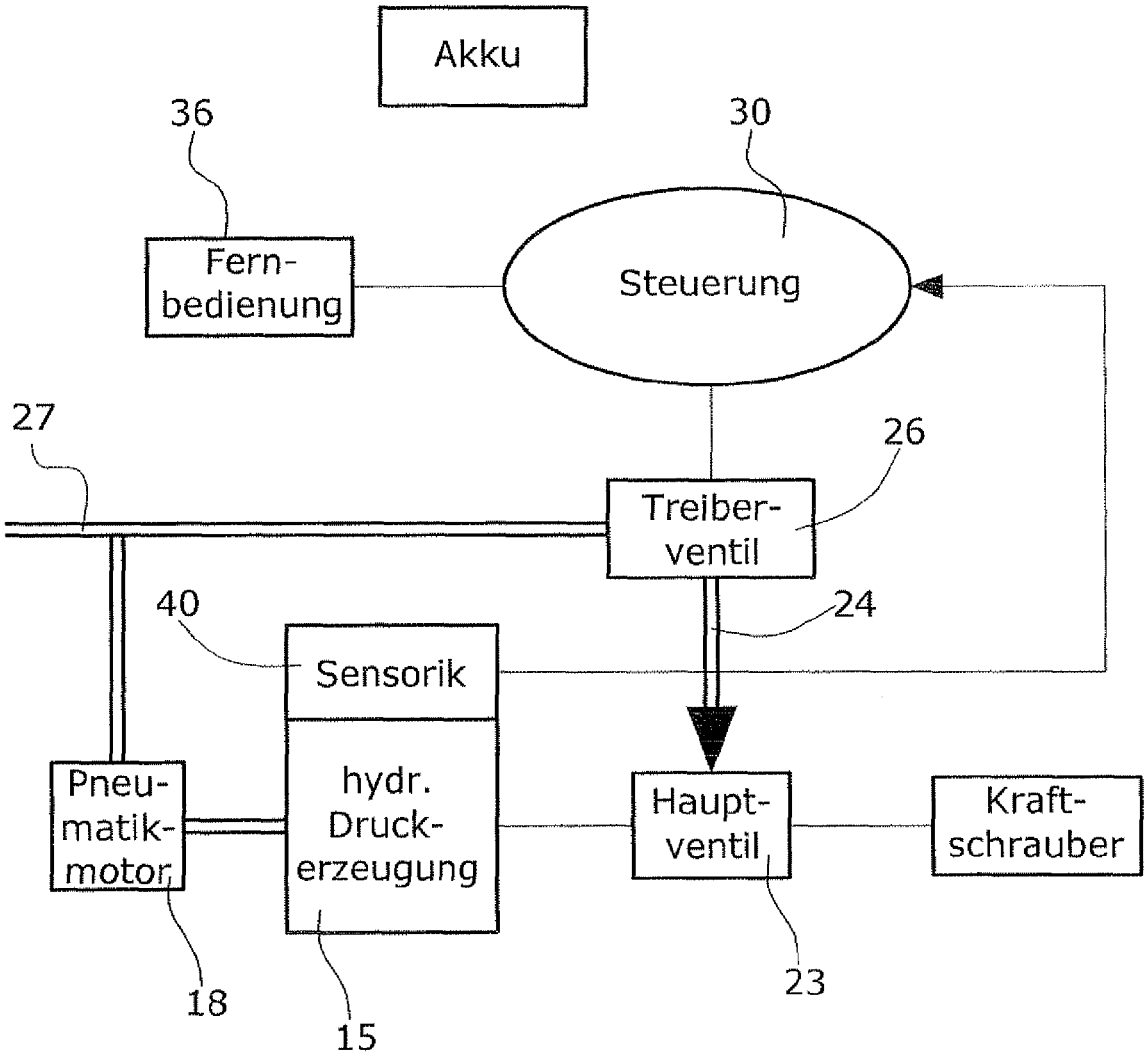
FIG. 2 is a diagram of the structure of the hydraulic aggregate.

The subdivision of the individual components into hydraulics, pneumatics and electrics is outlined in FIG. 2. The term electrics encompasses everything that is related to controlling, i.e. the sensorics 40 as well as the remote control unit 36. Of the pneumatic type, on the other hand, are the pneumatic motor 18 and the main valve 23.

The invention claimed is:

1. A hydraulic aggregate for feeding oil to a hydraulic power wrench, said aggregate comprising a reservoir containing oil and provided with a motor arranged in the reservoir as a submerged motor, a pump driven by said motor, and a control unit for controlling a reversal of the stroke direction of the power wrench in dependence on the pressure at the outlet of the hydraulic aggregate, wherein said motor is a pneumatic motor and that said control unit is designed as an electronic control unit, and wherein said control unit is connected, via an electric line, to an electrically controlled drive valve provided to control the supply of pressurized air to a main valve effecting said reversal of the stroke direction.

2. The hydraulic aggregate according to claim 1, wherein said control unit is accommodated in an explosion-proof device housing.

3. The hydraulic aggregate according to claim 1, wherein the control unit includes an accumulator for electric current supply of the electronic control unit.

4. A hydraulic aggregate for feeding oil to a hydraulic power wrench, said aggregate comprising a reservoir containing oil and provided with a motor arranged in the reservoir as a submerged motor, a pump driven by said motor, and a control unit for controlling a reversal of the stroke direction of the power wrench in dependence on the pressure at the outlet of the hydraulic aggregate, wherein said motor is a pneumatic motor and that said control unit is designed as an electronic control unit, and wherein the control unit includes an accumulator for electric current supply of the electronic control unit.

5. The hydraulic aggregate according to claim 4, wherein said control unit is accommodated in an explosion-proof device housing.

* * * * *